US009518335B2

(12) United States Patent
Zhang et al.

(10) Patent No.: US 9,518,335 B2
(45) Date of Patent: Dec. 13, 2016

(54) METHOD OF FABRICATING IMPROVED POROUS METALLIC MATERIAL AND RESULTING STRUCTURE THEREOF

(71) Applicant: CITY UNIVERSITY OF HONG KONG, Hong Kong (CN)

(72) Inventors: Jie Zhang, Hong Kong (CN); Yang Yang Li, Hong Kong (CN); Jian Lu, Hong Kong (CN)

(73) Assignee: CITY UNIVERSITY OF HONG KONG, Hong Kong (HK)

( * ) Notice: Subject to any disclaimer, the term of this patent is extended or adjusted under 35 U.S.C. 154(b) by 175 days.

(21) Appl. No.: 14/146,072

(22) Filed: Jan. 2, 2014

(65) Prior Publication Data

US 2015/0184309 A1 Jul. 2, 2015

(51) Int. Cl.

| | |
|---|---|
| ***C25F 3/14*** | (2006.01) |
| ***C25F 3/02*** | (2006.01) |
| ***C23F 1/00*** | (2006.01) |

(52) U.S. Cl.

CPC . *C25F 3/14* (2013.01); *C23F 1/00* (2013.01); *C25F 3/02* (2013.01)

(58) Field of Classification Search

USPC ..... 205/640–686

See application file for complete search history.

(56) References Cited

U.S. PATENT DOCUMENTS

2010/0147800 A1* 6/2010 Li ..... B82Y 20/00 216/56

2010/0282613 A1* 11/2010 Schuh ..... B23H 9/008 205/170

OTHER PUBLICATIONS http://web.archive.org/web/20121202104618/http://en.wikipedia.org/wiki/Casting, Dec. 2, 2012.*

MRS Bulletin; "Alloy Corrosion"; vol. 24, issue 7, pp. 24-28; R.C. Newman, S.G. Corcoran, J. Erlebacher, M.J. Aziz and K. Sieradzki; 1999.*

Ding, et al., "Nanoporous Gold Leaf: 'Ancient Technology'/Advanced Material." Adv. Mater, 2004, vol. 16, No. 21, pp. 1897-1900.

Jia, et al., "Nanoporous metal (Cu, Ag, Au) Films with High Surface Area: General Fabrication and Preliminary Electrochemical Performance." J. Phy. Chem, 2007, vol. 111, No. 24, pp. 8424-8431.

Arico, et al., "Nanostructured Materials for Advanced Energy Conversion and Storage Devices. Nature Materials," 2005, vol. 4, pp. 366-377.

Lang, et al., "Nanoporous Metal/Odixe Hybrid Electrodes for Electrochemical Supercapacitors." Nature Nanotechnology, 2011, vol. 6, pp. 232-236.

(Continued)

*Primary Examiner* — Nicholas A Smith

(74) *Attorney, Agent, or Firm* — Melvin S. Li, Esq.; Heslin Rothenberg Farley & Mesiti PC

(57) ABSTRACT

A porous metallic material for making a structure is fabricated by subjecting the material structure to Surface Mechanical Attrition Treatment (SMAT) once, using the SMAT-treated structure as an electrode, and selectively etching away at least one metal component in the SMAT-treated structure once, thus forming an etched-away structure. Additional SMAT treatment and/or etching treatment to the etched away structure may be performed. The resulting structure has improved physical characteristics.

9 Claims, 6 Drawing Sheets

(56) References Cited

OTHER PUBLICATIONS

Kong, et al., "Electrochemical Fabrication of a Porous Nanstructured Nickel Hydroxide Film Electrode with Superior Pseudocapacitive Performance." Journal of Alloys and Compounds, 2011. vol. 509, pp. 5611-5616.
Pikul, et al., "High-Power Lithium Ion Mcrobatteries from Interdigitated Three-Dimensional Bicontinuous Nanoporous Electrodes." Nature Communications, 2013, pp. 1-5.
Tsang, et al., "Metal-Based Photonic Coatings from Electrochemical Deposition." Journal of the Electrochemical Society, 2009, pp. D508-D512.
Tsang, et al., "Electrochemical Fabrication of Coaxial Wavy-Channel NilllO (OH)/Ni Nanocomposites for High-Performance Supercapacitor Electrode Materials." Energy Technology, 2013, pp. 478-783.
Li, et al., "Nanostructured Intermetallics Prepared by DeAlloying from Single Crystal Nickel-Based Superalloys." Intermetallics, 2009, vol. 17, pp. 1065-1069.
Lu, et al., "Synthesis of Porous Copper from Nanocrystalline Two-Phase Cu—Zr Film by Dealloying." ScienceDirect, 2007, vol. 56, pp. 165-168.
Senior, et al., "Synethis of Tough Nanoporous Metals by Controlled Electrolytic Dealloying." Nanotechnology, 2006, vol. 17, pp. 2311-2316.
Sun, et al., "Fabrication of Nanoporous Nickel by Electrochemical Dealloying." Chem. Mater, 2004, vol. 16, pp. 3125-3129.
Qian, et al., "Ultrafine Nanoporous Gold by Low-Temperature Dealloying and Kinetics of Nanopore Formation." Applied Physics Letters, 2007, vol. 91, No. 10, pp. 083105-01 to 083105-02.
Eriebacher, et al., "Evolution of Nanoporosity in Dealloying." Letters to Nature, 2001, vol. 410, pp. 450-453.
Varkey, et al., "Solution Growth Technique for Deposition of Nickel Oxide Thin Films." Department of Physics, University of Switzerland, 1993, 6 pages.
Kim, et al., "Ni—NiO Core-Shell Inverse Opal Electrodes for Supercapacitors." Checm Comm., 2011. vol. 47, pp. 5214-5216.
Huang, et al.,: Structure Evolution and Thermal Stability of SMAT-Derviced Nanograined Layer on Ti-25Nb-3Mo-3Zr-2Sn Alloy at Elevated Temperatures. Journal of Alloys and Compounds, V2013, vol. 554, pp. 1-11.
Deng, et al., "Three-Dimensionally Ordered Macroporous Cu2O/Ni Inverse Opal Electrodes for Electrochemical Supercapacitors." Phys. Chem. Chem. Phys., 2013, vol. 15, pp. 7479-7483.
Simon, et al., "Materials for Electrochemical Capacitors." Nature Materials, 2008, vol. 7, pp. 845-854.
Lin, et al., "Modeling the Effects of Electrode Composition and Pore Structure on the Perormance of Electrochemical Capacitors." Journal of Electrochemical Society, 2002, vol. 149, pp. A167-A175.
Balusamy, et al., "Effect of Surface Mechanical Attrition Treatment (SMAT) on Boronizing of EN8 Steel." Surface and Coatings, 2012, vol. 213, pp. 221-228.
Lattanzi, et al,. "Supercapacitor Electrodes with High-Energy and Power Densities Prepared from Monolithic NiO/Ni Nanocomposites" 2011, vol. 50, pp. 6847-6850.
Pang, et al., "Porous Nickel Oxide Nanospindles with Huge Specific Capacitance and Long-Life Cycle." RSC Advances, 2012, vol. 2, pp. 2257-2261.
Tong, et al., "Nitriding Iron at Lower Temperatures." Science, 2003, vol. 299, pp. 686-688.
Wang, et al., "Diffusion of Chromium in Nanocrystalline Iron Produced by Means of Surface Mechanical Attrition Treatment." Acta Materialia, 2003, vol. 51, pp. 4319-4329.
Lin, et al., "Surface Nanocrystallization by Surface Mechanical Attrition Treatment and its Effect on Structure and Properties of Plasma Nitrided AISI 321 Stainless Steel." Acta Materialia, 2006, vol. 54, pp. 5599.5605.

* cited by examiner

METHOD OF FABRICATING IMPROVED POROUS METALLIC MATERIAL AND RESULTING STRUCTURE THEREOF

FIELD OF INVENTION

The present invention is concerned with fabricating improved porous metallic material, and structure made from such metallic material.

BACKGROUND OF THE INVENTION

In the context of material science, nanoporous materials have a wide range of applications. However, conventional nanoporous materials tend to suffer from one or more disadvantages including low purity, coarse nanostructures, poor mechanical performance, complications and/or relatively high cost in manufacturing, and low production rate.

The present invention seeks to address one or more of these advantages, or at least to provide an alternative to the public.

SUMMARY OF THE INVENTION

According to a first aspect of the present invention, there is provided a method of fabricating porous metallic material for forming a structure, comprising the steps of i) providing a structure made of an alloy material, ii) subject the structure to Surface Mechanical Attrition Treatment (SMAT), thus forming SMAT-treated structure, and iii) selectively etching away at least one metal component in the SMAT-treated structure, thus forming an etched away structure. The successive use of steps i) to iii) or at least steps ii) and iii) is able to generate porous metallic structure with higher purity, finer nanostructures, better mechanical performance, lower in production cost and/or higher in production. In order to improve or tailor the nano- or physical characteristics of the final structure, additional SMAT treatment and/or etching treatment may be used to strengthen porous materials, adjust the pore size or porosity, purify the porous material, and/or accelerate effect of etching in the final structure. In one embodiment, after step ii), the first SMAT-treated structure may be used as an electrode by subjecting to an electric field.

Preferably, the alloy material may consist of at least two metal species.

Preferably, the alloy material may comprise two metal components. The alloy material may comprise three metal components.

In an embodiment, the method may include, in step iii), a step of applying a voltage or current profile. The voltage or current profile may be periodic.

Suitably, the metal component may be reactive metal.

In one embodiment, the method may, after step iii), include a step of treating the etched away structure by modifying chemical composition or structural features thereof.

In another embodiment, the method may, after step iii), include a step of treating the etched away structure by applying a coating thereon.

In yet another embodiment, the method may, after step iii), include a step of heating the etched away structure. The heating may be conducted in an oxygen-containing environment for forming metal oxide components.

The method, after step iii), may include a step of attaching chemical species to surface of the etched away structure.

The chemical species may be selected from the group consisting of organic molecules, inorganic molecules, and biomolecules.

The method, in step iii), may include a step of immersing the SMAT-treated material in an etching solution.

In step i) of the method, the alloy material may be formed on a substrate or foam before subjecting to the selectively etching in step iii).

Preferably, the alloy material may comprise Ni and Cu in any combination ratio. However, studies have shown that one preferable workable ratio of Ni and Cu in the alloy material is $Ni_{50}Cu_{50}$ (weight ratio).

The method may comprise a step of separating the etched away structure from a substrate and using the etched away and separated structure as a free standing film.

The porous material may be a/or used as functional material of electrode, photonic material, filter, catalyst or structural material.

BRIEF DESCRIPTION OF THE DRAWINGS

Some embodiments of the present invention will now be described, with reference to the accompanied drawings, in which:

FIG. 4 are optical microscopy images of an alloy (CuZn30), in which:

FIGS. 4(*a*1) and 4(*a*2) are images taken of the alloy when received;

FIGS. 4(*b*1) and 4(*b*2) are images taken of the alloy when annealed at 500° C. for 1.5 hours;

FIGS. 4(*c*1) and 4(*c*2) are images of the alloy when annealed at 600° C. for 1 hour;

FIGS. 6*a* to 6*c* are graphs showing analysis of SMAT- and dealloying-treated alloy (CuZn) with SMAT treatment time from 0 to 12 minutes, in which:

FIG. 6*a* is a graph showing the XRD patterns;

FIG. 6*b* is a graph showing the (220) diffraction peaks; and

FIG. 6*c* is a graph showing the full width at half maximum.

DETAILED DESCRIPTION AND PREFERRED EMBODIMENTS OF THE INVENTION

Figure 1:
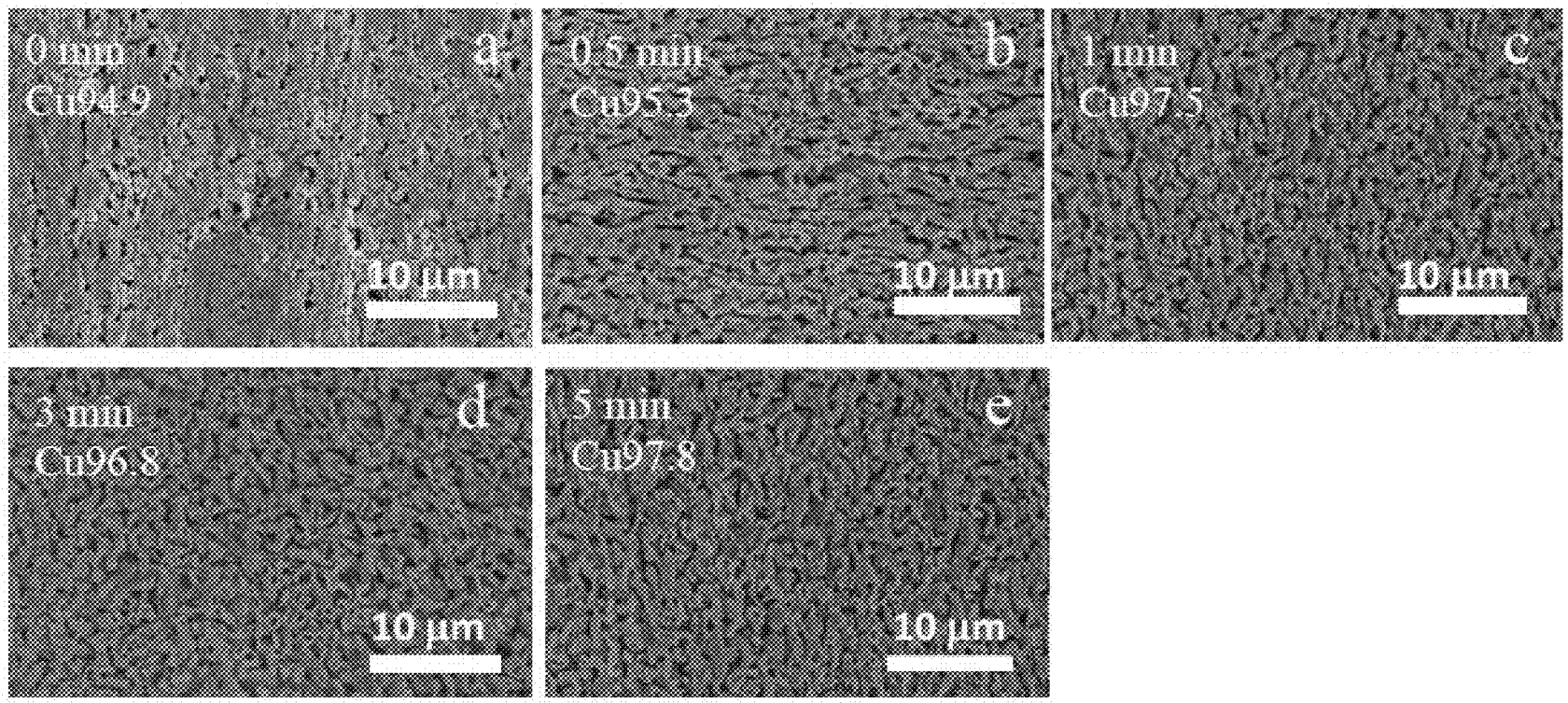
FIGS. 1*a* to 1*e* are photographical images in plane-view SEM images of dealloyed Cu films that had been SMAT-treated before dealloying treatment (by way of etching) for different time durations.

One aspect of the present invention is concerned with an improved method of fabricating nanoporous materials. In a broad sense, the method firstly involves the construction of an alloy material. This may be achieved by electro-deposition or melting. After the alloy material has been constructed, the alloy material is subjected to mechanical pre-treatment procedures. In a preferred embodiment, the mechanical pre-treatment procedures make use of Surface Mechanical Attrition Treatment (SMAT) techniques. The alloy material after having being mechanically treated is then subjected to dealloying. Preferred methodology includes subjecting the SMAT-treated alloy with chemical treatment. Specifically, the SMAT-treated alloy is etched in a chemical solution under a workable electric field. The electric field may be DC or pulsed voltage/current to selectively remove one metal component in order to create a desired porous characteristic in the final structure. The porous characteristics, among other characteristics, are desirable from a material science point of view, due to an enlarged surface area and mechanical properties.

The aforementioned methodology allows for surface of the as-formed structure for further treatment. For example, the as-formed structure may be subjected to, for example, thermal treatment or chemical modification. The methodology and the subsequent further treatment can enhance the surface of the structure and/or to coat electro-active materials on the surface for the specific applications such as batteries or super capacitors. Specific parameters of the initial SMAT treatment, the subsequent selective etching, and post-treatment can all be adjusted to tailor to specific requirements of the structures and chemistry of the porous structure, and thus optimizing the materials properties for specific applications.

This invention combines SMAT techniques and electrochemical methods to generate purer, lighter, and stronger porous metals with larger surface area, which can be achieved in an automated manner. In a typical process of the present invention, for example, a binary alloy material first undergoes SMAT treatment by being placed in a chamber and bombarded with tiny metal balls, and then the SMAT treatment alloy is etched in an electrolyte with or without a voltage/current profile applied to selectively remove one metal component. In other embodiments, the alloy material may comprise more than two metal components or species.

Further information regarding the present invention and experimental data in support of the working of the invention are illustrated below.

Nanoporous metals (such as W, Ni, Au, Ag, Cu, and Pt) are important and they are useful with a wide range of applications. For example, nanoporous Ni may be used as photonic materials, electrochemical capacitors, or electrocatalysts for hydrogen evolution. One way to generate porosity in an alloy material is by dealloying. This is done by selectively dissolving the more reactive metal component from an alloy system. However, conventional dealloying techniques are generally not efficient in removing the reactive metal component in the alloy. As a result, the dealloyed materials tend to possess weak mechanical strength. Furthermore, conventional dealloying techniques generally lead to thick ligaments and a low porosity, indicating a small surface area, undesirable for many practical applications, e.g., as catalysts.

The present invention provides a novel approach in which an alloy system is pre-treated with SMAT technique. Studies have shown that the SMAT treatment introduces defects (such as, nanotwins, reduced grain sizes and increased grain boundaries) in the treated materials and strengthen the treated materials. In other words, the SMAT pre-treatment of the alloys can result in a more thorough and efficient removal of the more reactive metal component at a higher etching rate (due to the increased chemical reactivity), much thinner ligaments of the porous metallic framework (due to the reduced grain size), and improved mechanical strength of the porous metallic structure (due to strengthening effect of SMAT). The combination of SMAT-pretreatment and dealloying techniques for fabricating porous metallic materials has been found to produce unexpected results. It was found that, comparing with conventional dealloying method, dealloying with the SMAT pretreatment provides a simple but powerful method to conveniently control the structures, compositions, and mechanical performance of the porous metals generated, e.g. more porous, purer, and tougher metallic structure can be easily achieved, and to effectively lower the Dealloying Threshold (defined as the compositional threshold of the more reactive metals required for dealloying to take place).

The structure formed as a result of the SMAT treatment and dealloying may be used as electrode materials. The specific applications of these materials are wide-ranging and of far-reaching importance. For example, structure formed in accordance with this invention is naturally-suited for constructing electrode materials with low internal series resistance. The electrode materials thus obtained can be employed in lithium-ion batteries, solar cells, water-photosplitting devices and super capacitors. Besides electrode materials, this invention also provides an efficient method for constructing other functional structures such as photonic materials, catalysts, chemical and biological sensors, and biomedical devices (e.g., drug carrier materials). Taking the biomedical materials as an example, the fabrication method described here can be used for manufacturing metallic porous structures that can be used to load drugs. Furthermore, porous structures based on metal compounds (e.g., metal oxides) or porous nanocomposites based on metal compounds/metals core/shell structures can also be fabricated using the method reported here. This is done by converting the as-dealloyed metallic porous structures by further treatments, such as thermal treatment in oxygen, nitrogen or other atmosphere, or solution treatments. The metal compounds-based porous structures thus obtained, e.g. metal oxide networks or metal oxide/metal core/shell nanocomposites, can be potentially applied for numerous applications, such as lithium-ion batteries, solar cells, water-photosplitting devices and super capacitors. Therefore, this invention can enable a wide range of functional materials.

In contrast with the present invention, conventional dealloying technologies typically do not apply electric field or at least not constant voltage/current. It lacks flexibility in generating the porous structural features or control in the purity of the final metal materials.

The present invention making use of combination SMAT-dealloying method not only fully inherits the fabrication advantages of the conventional dealloying method for making porous metallic materials, but also greatly improves the conventional method by adding on more flexibility and control in fine tuning the morphology, purity, and mechanical properties of the finally obtained porous metallic materials.

With the use of SMAT pre-treatment, high requirement on engineering precision on the as-formed porous material obtained can be achieved without costly equipment such as vacuum, clean room, or sophisticated control systems which are generally required by other micro-processing technologies for making nanoporous metallic structures, e.g. the expensive and complicated micro-fabrication methods derived from microelectronics. The application of the present invention is compatible with convenient large-area fabrication with high uniformity that can be readily mass produced on an industrial scale. Further, the present invention allows for tailor-made, elaborate structural profiles be accurately targeted and achieved with high purity. The structural features of the product can be easily adjusted by modifying the experimental parameters of the SMAT-dealloying treatment. It is also to be noted that a wide range of metal and metal compound species can be fabricated.

Since the present invention involves relatively few steps, it can be conveniently tailored for automation for industry-scale mass production.

Experiments leading to the present invention were conducted to demonstrate workability and advantages of the invention. Highly porous metallic structures with high purity and larger surface area have been produced conveniently at a faster speed. The structural features of the electrode can be directly adjusted by modifying the SMAT and electrochemical parameters. Taking the Cu/Zn binary system for example, it is demonstrated that porous material made in accordance with the present invention method has the following advantages:

- Significantly lowering the compositional threshold of the more reactive metal component (i.e., Zn, in this study) for the dealloying reaction to take place
- More thoroughly removing Zn and thus producing porous Cu of higher purity
- Greatly affecting the morphology of the generated porous Cu framework, e.g. leading to significantly bigger pores and thinner ligaments, higher porosity/surface area
- Greatly increase the dealloying etching speed Due to wide-ranging practical impact of nanoporous metal-based materials, the present invention can enable applications that lead to products such as super capacitor electrodes/lithium-ion battery electrodes. This invention is well suited to fabricate super capacitor electrodes with large surface areas and low internal resistance.

Porous material made in accordance with the present invention can be used to make high surface-area photovoltaic electrodes, in particular, Schottky barrier solar cells can be fabricated with metal (e.g., Ni) coated with a thin layer of p-type semiconductor (e.g. NiO). The present invention allows for lower cost production and thus for mass production. Further, the photovoltaic electrodes made from the porous materials of the present invention will have the enhanced characteristics of a) light can be efficiently absorbed by the highly porous structure, b) the interface area of the nanostructured materials is high, c) the charge carriers can efficiently transport to the charge collector through the Ni framework, leading to low internal resistance, and d) the thickness of these semiconductor coatings can be gradually varied along the film thickness, which will enable a gradually changed energy bandgap, giving a multi-junction absorption effect along the film thickness. All these features will greatly enhance light absorption and cell efficiency.

The following describes experiments illustrating the present invention.

EXPERIMENTS

1. Preparation of Porous Copper

The starting material used in this study is the Cu—Zn alloy sheets commercially produced under the trade name of CuZn30 ($Cu_{63}Zn_{37}$ by weight). All chemicals in this study are of analytical grade and used without further purification. The alloy sheets were treated using the Surface Mechanical Attrition Treatment (SMAT) techniques at room temperature for different time durations. 20 grams of stainless steel balls (diameter of 2 mm) with the vibration frequency of 20,000 Hz, and impact velocity of 10 m/s were used. Dealloying of the SMAT-treated alloy sheet was then performed in the aqueous solution of hydrochloric acid (HCl, 37%) at 90° C. for a period of time (typically 1 hr). The sample was rinsed and dried under a nitrogen stream after the dealloy treatment.

Besides directly using the as-received commercial CuZn30 material for the SMAT-dealloying treatments, thermally annealed CuZn30 sheets were also tested. This is to reduce the defects and residual stress in the commercial CuZn30 material which was possibly cold-rolled during the commercial manufacturing process. Thermal treatment was carried out at a temperature range from 400° C. to 600° C. in Ar atmosphere.

To examine the cross-section, the sample was polished to a mirror finish and then etched in an aqueous solution of iron (III) chloride (97%) and hydrogen peroxide (30%).

2. Microstructure Characterization

Crystallinity and grain size were examined by an X-ray diffractometer (XRD, Rigaku SmartLab). Sample morphology and chemical composition were investigated using a scanning electron microscope (SEM, JEOL JSM-820) equipped with an X-ray energy-dispersive spectroscopy (EDS, Oxford INCA 7109). The sample mechanical properties were examined by nanoindentor (Hysitron TI 950 TriboIndenter).

Results

1) Compared with the samples that are not SMAT-treated beforehand, porous metal (Cu in this study) material obtained with the SMAT pretreatment shows significant higher porosity and thinner ligament (FIG. 1). Significant improvement can be observed with a SMAT pretreatment as short as 0.5 min.

FIG. 1 are plan lane-view SEM images of the dealloyed Cu films that were SMAT-treated before the dealloy treatment for different time durations: (a) 0 min (the final film composition is $Cu_{94.9}Zn_5$ by weight); (b) 0.5 min (the final film composition is $Cu_{95.3}Zn_{4.7}$ by weight); (c) 1 min (the final film composition is $Cu_{97.5}Zn_{2.5}$ by weight); (d) 3 min (the final film composition is $Cu_{96.8}Zn_{3.2}$ by weight); (e) 5 min (the final film composition is $Cu_{97.8}Zn_{2.2}$). The CuZn30 sheets were used as received without thermal treatment.

2) It is demonstrated that the SMAT pretreatment is able to significantly accelerate the dealloying etching rates, resulting in a thicker porous metal (Cu in this study) film. For example, after dealloying treatment for 1 hr, the depth of the dealloyed surface layer is approximately 12 and 20 μm for the sample that undergoes the SMAT pretreatment for 0 and 20 min, respectively (FIG. 2).

Figure 2:
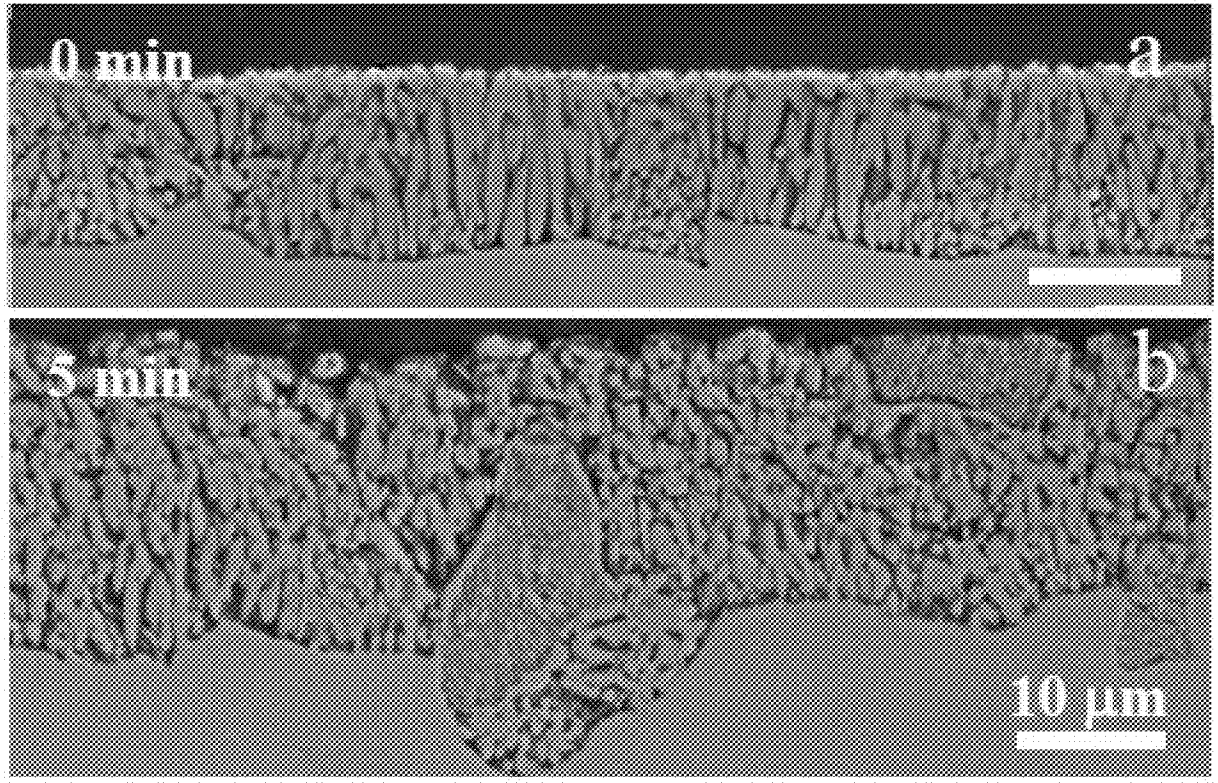
FIGS. 2*a* to 2*b* are photographical images in cross-sectional SEM images of dealloyed porous films that had been SMAT pre-treated for 0 minute and 5 minutes, respectively.

FIG. 2 are cross-sectional SEM images of the dealloyed porous Cu films that were SAMT pretreated for 0 and 5 min. The CuZn30 sheets were used as received without thermal treatment.

FIG. 3 illustrates depth-dependent hardness distribution of the compact Cu—Zn alloys (not dealloyed yet) that are SMAT-treated for 1 min (a) and 12 min (b). Surface hardness vs. SMAT treatment duration, before (c) and after (d) the dealloy treatment. The dash lines in a) and b) (on left) indicate the film central depth. Studies have shown that a step of SMAT treatment for 30 seconds to 2 minutes can achieve sufficient porosity in final structure in that the hardness is not compromised. While subjecting the alloy material for SMAT treatment for 12 minutes or longer can further enhance the porosity in the final structure or tailor the special porous requirements, the hardness will be compromised. In other words, the SMAT treatment time may range from 30 seconds to 12 minutes, although 30 seconds to 2 minutes is a preferable range. Studies have shown that about 1 minute is an optimal SMAT time. This SMAT time duration can achieve a balance of porosity and hardness.

Figures 3A, 3B, 3C, 3D:
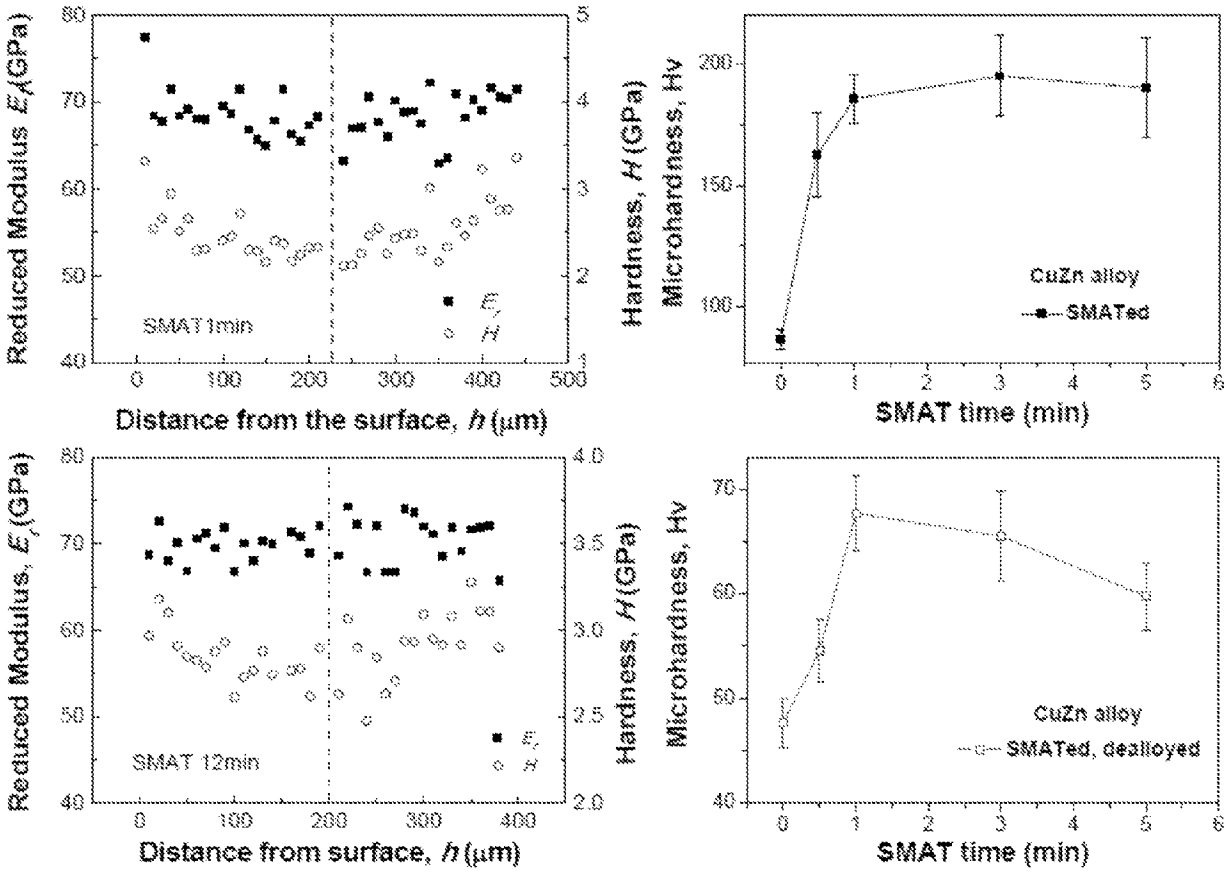
FIGS. 3*a* to 3*b* (left) are graphs illustrating the physical characteristics of an alloy material (Cu—Zn) before dealloying but subjected to SMAT treatment for 1 minute and 12 minutes, respectively.
FIGS. 3*c* to 3*d* (right) are graphs illustrating the relationship of physical characteristics and time duration of SMAT treatment before and after dealloying treatment.
Figure 6:
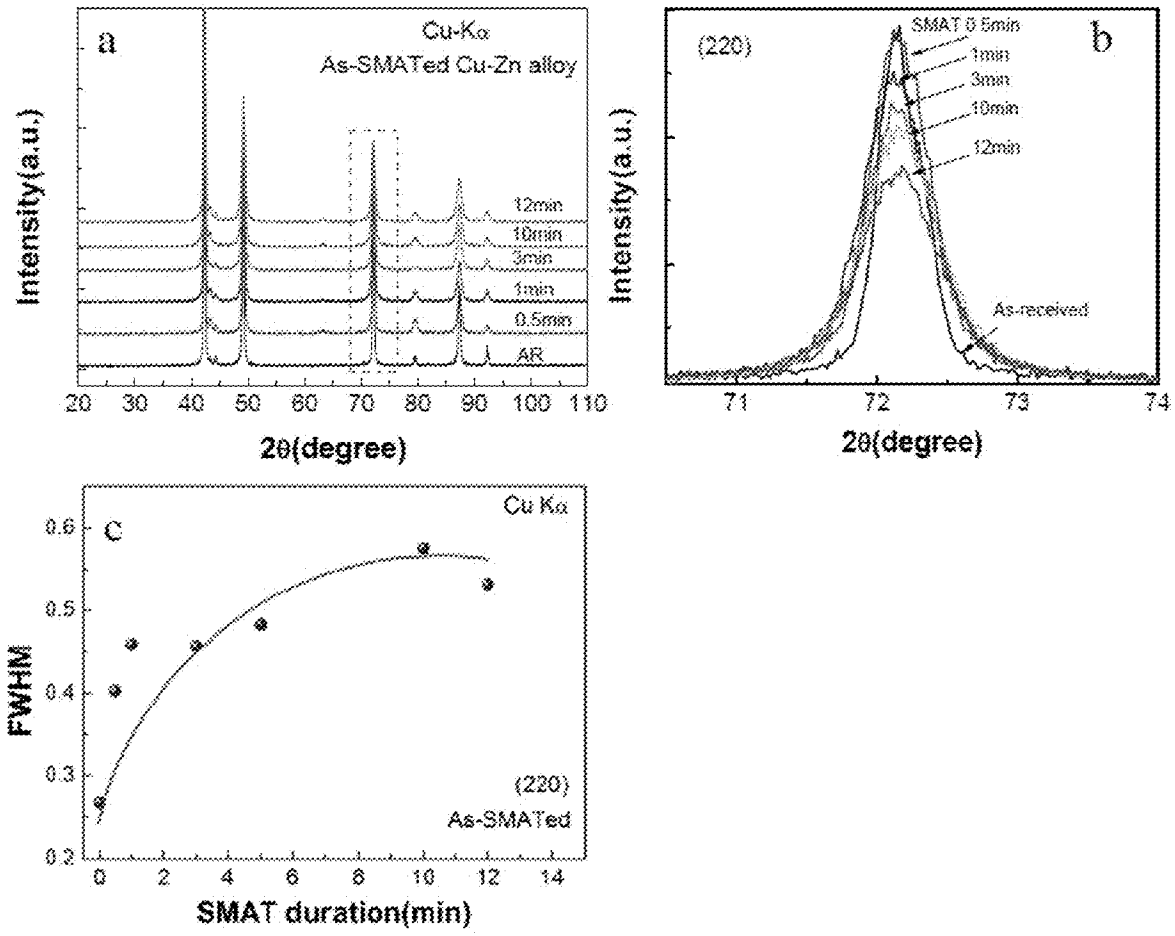

During the course leading to the present invention, it is shown that the SMAT pretreatment is able to significantly enhance the surface hardness of the porous metal films. For example, the surface hardness of the dealloyed Cu film increases by ~40% with the SMAT pretreatment of 1 min (FIG. 3*d*). With a longer SMAT pretreatment duration (3 and 5 min), the surface hardness of dealloyed Cu gradually decreases but still remains to be higher than the non-SMAT-treated control, which is possibly due to the fact that a longer SMAT treatment results in a more porous structure (FIG. 1). The observed enhancement in surface hardness can be possibly attributed to the effects of grain refinement, residual stress, and/or the formation of a large number of dislocations induced in the SMAT-treated samples (FIG. 6). Therefore, the strengthening effects of the SMAT pretreatment persist after the dealloying treatment.

Figure 4:
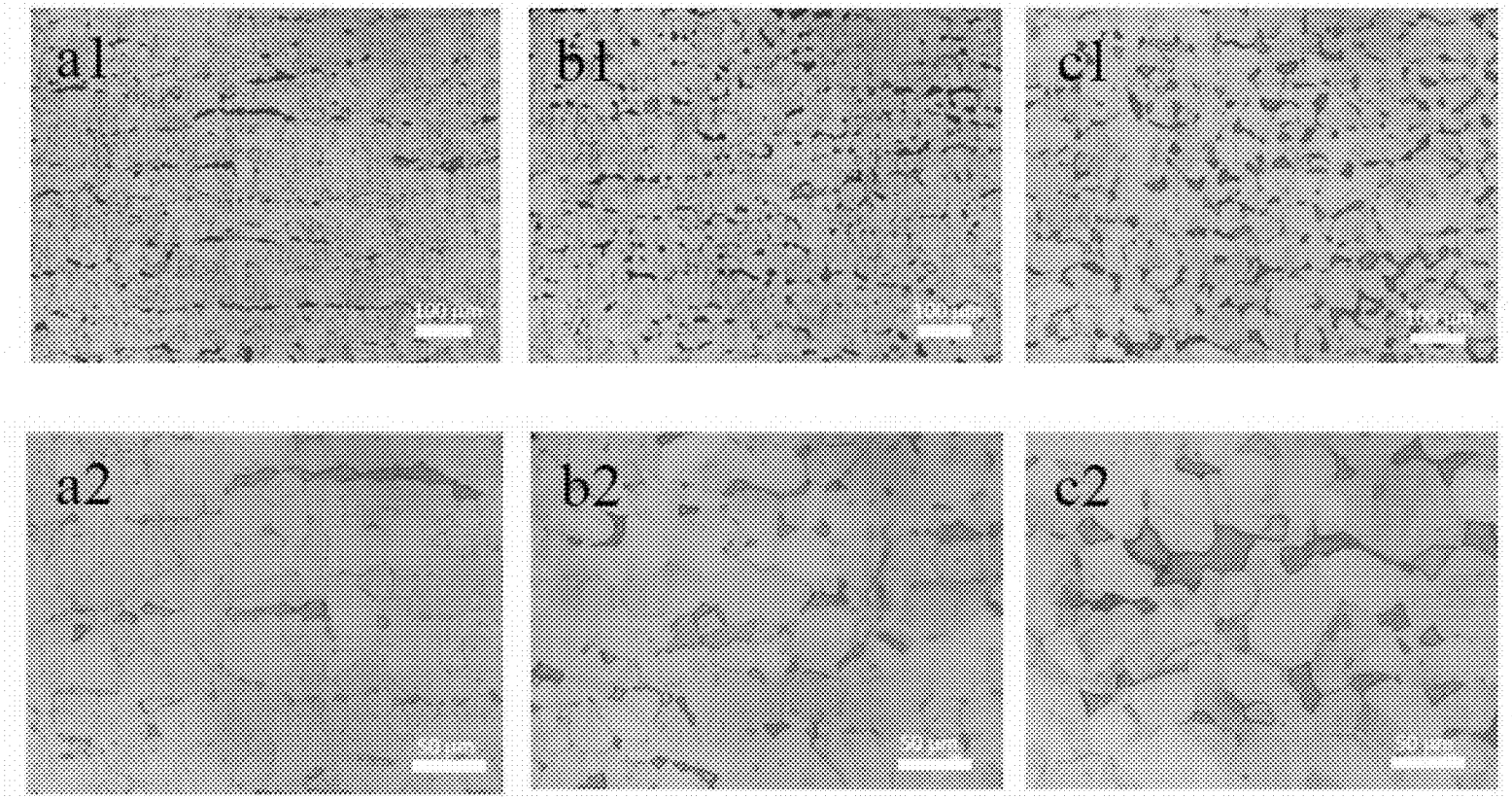

FIG. 4 are optical microscopy images of the CuZn30 alloys: (a1, a2) as-received; (b1, b2) annealed at 500° C. for 1.5 hr; (c1, c2) annealed at 600° C. for 1 hr. The scale bars indicate 50 and 100 □m for (a1, b1, c1) and (a2, b2, c2), respectively.

The thermally annealed CuZn alloys show less distorted grain shapes with bigger grain sizes, particularly for samples annealed at 600° C. for 1 hr (FIG. 4 C1 and C2). Two phases (dark and brighter regions in FIG. 4) are detected from the optical microscopy study. The SMAT and dealloying treatments are performed on the annealed CuZn alloys.

Figure 5:
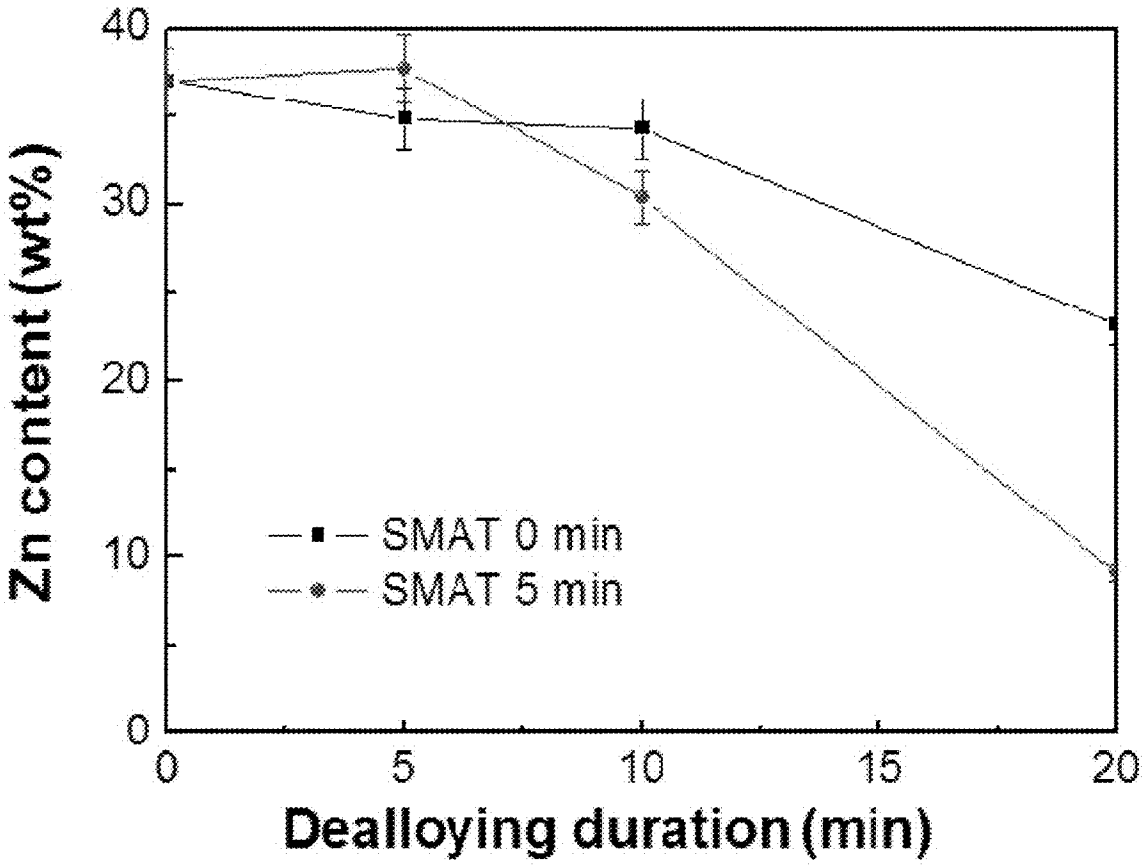
FIG. 5 is a graph showing composition change as a function of dealloying time for alloy (Cu—Zn alloy sheets) not pretreated with SMAT and pretreated with SMAT for 5 minutes, respectively.

To study the evolution of the porous structure during the dealloying process, samples dealloyed for different time durations are examined (FIG. 5). It can be seen that the SMAT-pretreatment significantly changes the dealloying kinetics.

FIG. 5 illustrates composition change as a function of the dealloying time for the Cu—Zn alloy sheets that were not pretreated with SMAT and that were pretreated with SMAT for 5 min. The Cu—Zn alloy sheets were annealed beforehand at 600° C. for 1 hr.

In summary, the SMAT pretreatment of the alloy substrate more rapidly lead to finer porous structure with higher porosity and thinner ligaments. The porous metal frameworks thus obtained are likely to process significantly larger specific surface areas, desirable for various applications, such as catalysts, sensors, and supercapacitor electrodes.

The XRD analysis (FIG. 6) reveals that the full width at half maximum (FWHM) of the diffraction peak keep increasing with the longer SMAT pretreatment time, indicating the grain size-reduction effects of the SMAT.

FIG. 6 illustrate XRD analysis of the SMAT-dealloy treated CuZn alloys with the SMAT pretreatment time ranging from 0 min ("AR") to 12 min: a) the XRD patterns; (b) the (220) diffraction peaks. (c) the full width at half maximum (FWHM).

The following commercial products can be made from porous materials made in accordance with the present invention.

High-Absorption Photovoltaic Electrode Materials

The fabrication techniques of this invention will generate high-absorption photovoltaic electrode materials that are be of strong interest to the market of solar cells.

Instrumentation

The electrode materials enabled by this invention can be used as high-surface-area metallic sample holders for the fluorescence microscopes, infrared spectroscopy, Raman spectroscopy, and mass spectroscopy. These sample holders can be used for in-situ studies under an electric field and for improving the instrument sensitivities due to the surface plasmon resonance effect.

Light-Emitting Devices

This invention will provide a type of economical electrode materials for light-emitting devices.

Smart Filters, Catalysts, and Foams

This invention will supply the new functions of electrodes to the traditional porous materials that are used as filters, catalysts and foams.

Anti-Bacteria Particles/Pollutant Degradation

This will be made possible by fabricating the electrode structure with a coating of photocatalysing substances (such as $TiO_2$), in which the highly absorbent materials fabricated by this invention trap and transfer the photonic energy to the photocatalysts.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. A method of manufacture of an electrode having a porous metallic material and a coating of varying thickness on the porous material, comprising sequential steps of:

i) providing, by way of melting, a structure made of an alloy system with at least a first metal component of Cu or Zn and a second metal component selected from the group consisting of Au, Ag, Pt and Cu, wherein the first metal component is more reactive than the second metal component;

ii) subjecting the structure to Surface Mechanical Attrition Treatment (SMAT) for duration varying from 30 seconds to 12 minutes, forming a first SMAT-treated structure;

iii) selectively etching away the more reactive first metal component in the SMAT-treated structure by immersion in an electrolyte of hydrochloric acid with or without a voltage field applied, thus forming a first etched away or fabricated porous structure of Au, Ag, Pt or Cu; and iv) electrochemically depositing electroactive material onto the fabricated porous Au, Ag, Pt or Cu with varied deposition amount.

2. A method as claimed in claim 1, comprising a step, after step by using the first SMAT-treated structure as an electrode substrate.

3. A method as claimed in claim 1, the etched structure is coated with electroactive material, as a final structure for supercapacitor electrode.

4. A method as claimed in claim 1, wherein the alloy system consists of the first metal component and the second metal component.

5. A method as claimed in claim 1, wherein, after step iii), including a step of treating the etched away structure by applying a photocatalytic coating thereon.

6. A method as claimed in claim 1, wherein, after step iii), including a step of attaching chemical species to surface of the etched away structure.

7. A method as claimed in claim 6, wherein the chemical species is metal oxides.

8. A method as claimed in claim 1, wherein the first metal component and the second metal component are Zn and Cu, respectively.

9. A method as claimed in claim 1, comprising, in step iii), separating the etched away structure and using the etched away and separated structure as a free standing film.

* * * * *